US007195140B1

(12) United States Patent
Marinelli

(10) Patent No.: US 7,195,140 B1
(45) Date of Patent: Mar. 27, 2007

(54) HOLSTER FOR ATTACHING TO A LEG OF A USER AND HOLDING A HAMMER

(76) Inventor: Victor M. Marinelli, P.M.B. 143, 100 New State Hwy., Raynham, MA (US) 02767

( * ) Notice: Subject to any disclaimer, the term of this patent is extended or adjusted under 35 U.S.C. 154(b) by 484 days.

(21) Appl. No.: 10/790,558

(22) Filed: Mar. 1, 2004

(51) Int. Cl.
*A45C 1/04* (2006.01)

(52) U.S. Cl. ..... 224/222; 224/672

(58) Field of Classification Search ..... 224/222, 224/672

See application file for complete search history.

(56) References Cited

U.S. PATENT DOCUMENTS 2,618,419 A 11/1952 Vanish
2,852,824 A 9/1958 Kilpatrick
3,100,590 A 8/1963 Bohlsen
3,384,277 A 5/1968 Hodelka
5,605,263 A * 2/1997 Pursley et al. ..... 224/248
5,992,716 A 11/1999 Riley
6,217,072 B1 * 4/2001 Gregg ..... 280/823
6,557,739 B1 5/2003 Pursley et al.
2003/0042474 A1 * 3/2003 Boydon ..... 254/25

* cited by examiner

*Primary Examiner*—Jes F. Pascua
*Assistant Examiner*—Lester L. Vanterpool
(74) *Attorney, Agent, or Firm*—Richard L. Miller

(57) ABSTRACT

A holster for attaching to an leg of a user and holding a hammer in a position which provides complete freedom of movement of hands and feet of the user and which permits the user to remove the hammer with the same hand employed to use the hammer. The holster is made from a rod-like, slender, and elongated material, and includes an attaching portion attaching to the leg of a user and a holding portion extending from the attaching portion and cradling the head of the hammer therein, with the handle of the hammer extending upwardly therefrom, with the claw of the hammer extending replaceably through one side of the holding portion, and with the bell/poll of the hammer extending replaceably through the other side of the holding portion.

40 Claims, 1 Drawing Sheet

HOLSTER FOR ATTACHING TO A LEG OF A USER AND HOLDING A HAMMER

BACKGROUND OF THE INVENTION

1. Field of the Invention

The present invention relates to a holster for holding a hammer. More particularly, the present invention relates to a holster for attaching to a leg of a user and holding a hammer.

2. Description of the Prior Art

Numerous innovations for hammer holsters have been provided in the prior art that will be described. Even though these innovations may be suitable for the specific individual purposes to which they address, however, they differ from the present invention.

A FIRST EXAMPLE, U.S. Pat. No. 2,618,419 to Vanish teaches a tool holster comprising a clasp member adapted to be detachably secured to the clothing of a wearer, and a coiled wire spring loop member mounted on said clasp member and resiliently standing in an approximately horizontal plane when free of a tool, and occupying a downwardly and inwardly bent position when a tool is positioned therein with its handle extending through the loop of the loop member, the outer edge of the loop member when holding a tool being considerably lower than said horizontal position and the resiliency of said coiled wire causing the outer depressed end of the loop member to grip inwardly against the tool and cause the tool to be held close to the wearer's body, the clasp member including a pair of integrally connected outer and inner flat members resiliently urged toward each other, the outer member having a band pressed outwardly therefrom and integral with the outer member at both ends, the mounting of the loop member on the clasp member including an end portion at each end of the loop portion extending downwardly at approximately right angles to the main body of the loop member when free of a tool, said end portions being tightly gripped between said band and said outer flat member with said end portions substantially in contact with each other sidewise.

A SECOND EXAMPLE, U.S. Pat. No. 2,852,824 to Kilpatrick teaches a holder for a hammer of the type including a head and a reduced diameter shank, a body member including a back wall, a front wall, a bottom wall, first and second spaced parallel side walls, there being an arcuate recess in said body member defining a chamber for receiving the hammer head, said first side wall being provided with an arcuate cutout for the projection therethrough of said shank, said cutout being of smaller size than said recess whereby said head abuts the inner surface of said first side wall to prevent accidental displacement of the head out of said chamber, a spring member having one end secured to said first side wall, a bar having one end secured to said spring member, there being a slot in said second side wall, the outer end of said bar being of reduced size and projecting through said slot and out beyond said second wall, an L-shaped keeper including a leg pivotally connected to said second side wall, an arm arranged at right angles with respect to said leg and extending therefrom, a pivot pin extending through said leg and through said second side wall, and a spring member having one end connected to said keeper and its other end connected to said pivot pin, there being a pair of cutouts in said leg defining a pair of teeth for engaging the outer end of said bar.

A THIRD EXAMPLE, U.S. Pat. No. 3,100,590 to Bohlsen teaches a hammer holster for carrying a hammer with its handle in an upstanding position with relation to the head thereof, said holster comprising a generally vertically disposed back plate having front and rear faces, an upwardly opening elongated pocket secured to the front face of the lower portion of said back plate, said pocket being of a length generally approximating the length of said hammer head and adapted to receive the head of said hammer so that the handle thereof is disposed adjacent said back plate, hammer head retaining means at one end of said pocket adapted to retain one end of said hammer head and limiting upward movement thereof, and hammer handle retaining means connected to said back plate and adapted to limit transverse movement of said hammer handle when said hammer head is received within said pocket, said hammer handle retaining means comprising a lug secured to said backing plate and mounted for pivotal movements into and out of engagement with the hammer handle when the hammer is carried by said holster.

A FOURTH EXAMPLE, U.S. Pat. No. 3,384,277 to Hodelka teaches a holster for supporting a hammer, handle upward, from the rear pocket of a workman's trousers. A sheath which receives the head of the hammer is affixed to the lower end of a rigid backing plate. A spring steel, handle retaining clip is attached to the backing plate above the sheath. A second rigid plate, which is inserted into the rear pocket, is attached to the upper edge of the backing plate.

A FIFTH EXAMPLE, U.S. Pat. No. 5,992,716 to Riley teaches a releasable device for holding a tool in a holder, the tool for example being a hammer held in a hammer holder commonly used in the construction industry and having a loop loosely holding the hammer. The device is of flexible, stretchable material and has an aperture which may be pulled over a portion of the tool such as the hammer head to hold the tool to the holder. The device is secure to the loop of the hammer holder. Preferably, the device is a strip of flexible stretched material with an aperture and a series of holes and slits which permit the strap to be able to be looped around the hammer holder loop. The loop is releasably secured to a portion of the tool such as the head of the hammer.

A SIXTH EXAMPLE, U.S. Pat. No. 6,557,739 B1 to Pursley et al. teaches a device for securing a T-shaped tool such as a hammer to the leg of a user in a position which provides complete freedom of movement of hands and feet while carrying the tool and permits the user to remove the tool from the device with the same hand employed to use the tool.

It is apparent that numerous innovations for hammer holsters have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a holster for attaching to a leg of a user and holding a hammer that avoids the disadvantages of the prior art.

ANOTHER OBJECT of the present invention is to provide a holster for attaching to a leg of a user and holding a hammer that is simple to use.

BRIEFLY STATED, STILL ANOTHER OBJECT of the present invention is to provide a holster for attaching to an leg of a user and holding a hammer in a position which provides complete freedom of movement of hands and feet of the user and which permits the user to remove the hammer with the same hand employed to use the hammer. The holster is made from a rod-like, slender, and elongated material, and includes an attaching portion attaching to the leg of a user and a holding portion extending from the attaching portion and cradling the head of the hammer therein, with the handle of the hammer extending upwardly therefrom, with the claw of the hammer extending replaceably through one side of the holding portion, and with the bell/poll of the hammer extending replaceably through the other side of the holding portion.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 3:
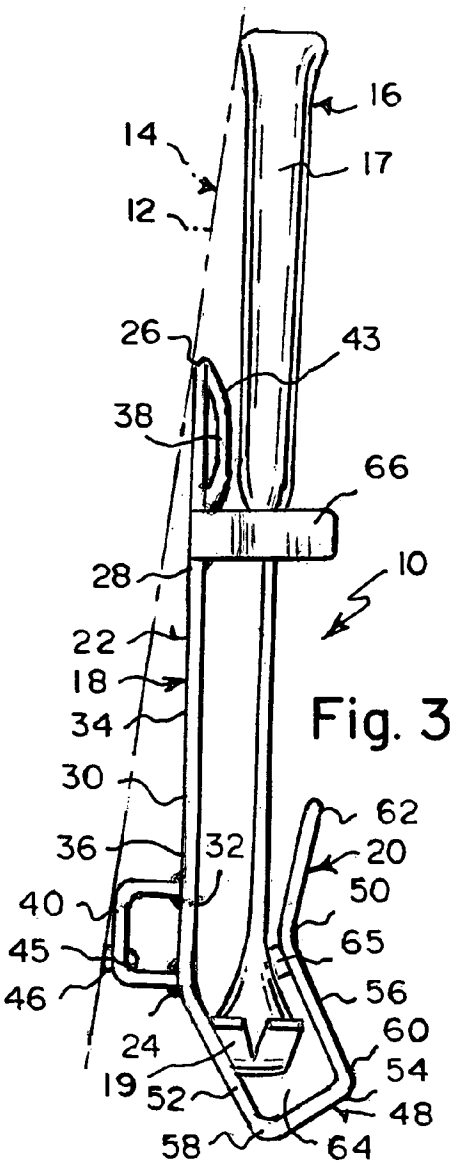
FIG. 3 is a diagrammatic side elevational view taken generally in the direction of ARROW 3 in FIG. 2.

10 holster of present invention for attaching to leg 12 of user 14 and holding hammer 16
12 leg of user 14
14 user
16 hammer
17 handle of hammer 16
18 attaching portion for replaceably attaching to leg 12 of user 14
19 head of hammer 16
20 holding portion for replaceably holding hammer 16 in position which provides complete freedom of movement of hands and feet of user 14 and which permits user 14 to remove hammer 16 with same hand employed to use hammer 16
21 claw of hammer 16
22 pair of extension members of attaching portion 18
23 bell/poll of hammer 16
24 lowermost end of each extension member of pair of extension members 22 of attaching portion 18
25 cheek of hammer 16
26 uppermost end of each extension member of pair of extension members 22 of attaching portion 18
28 upper portion of each extension member of pair of extension members 22 of attaching portion 18
30 intermediate portion of each extension member of pair of extension members 22 of attaching portion 18
32 lower portion of each extension member of pair of extension members 22 of attaching portion 18
34 first transition point of each extension member of pair of extension members 22 of attaching portion 18
36 second transition point of each extension member of pair of extension members 22 of attaching portion 18
38 upper loop of each extension member of pair of extension members 22 of attaching portion 18 for receiving upper strap 42 for strapping around leg 12 of user 14
40 lower loop of each extension member of pair of extension members 22 of attaching portion 18 for receiving lower strap 44 for strapping around leg 12 of user 14
42 upper strap for strapping around leg 12 of user 14
43 upper member of upper loop 38 of each extension member of pair of extension members 22 of attaching portion 18
44 lower strap for strapping around leg 12 of user 14
45 lower member of lower loop 40 of each extension member of pair of extension members 22 of attaching portion 18
46 cross member of attaching portion 18
48 pair of segment members of holding portion 20 for holding head 19 of hammer 16
50 forwardmost end of each segment member of pair of segment members 48 of holding portion 20
52 rear portion of each segment member of pair of segment members 48 of holding portion 20
54 lower portion of each segment member of pair of segment members 48 of holding portion 20
56 forward portion of each segment member of pair of segment members 48 of holding portion 20
58 first transition point of each segment member of pair of segment members 48 of holding portion 20
60 second transition point of each segment member of pair of segment members 48 of holding portion 20
62 connecting member of holding portion 20
64 cradle of holding portion 20 for replaceably cradling head 19 of hammer 16 therein, with handle 17 of hammer 16 extending upwardly therefrom, with claw 21 of hammer 16 extending replaceably through one segment member of pair of segment members 48 of holding portion 20, and with bell/poll 23 of hammer 16 extending replaceably through other segment member of pair of segment members 48 of holding portion 20
65 cross member of holding portion 20 for abutting against cheek 25 of head 19 of hammer 16 and urging head 19 of hammer 16 against rear portion 52 of each segment member of pair of segment members 48 of holding portion 20 so as to replaceably maintain head 19 of hammer 16 in cradle 64 of holding portion 20
66 catch of holding member 20 for replaceably capturing handle 17 of hammer 16 therein

DETAILED DESCRIPTION OF THE INVENTION

Figure 1:
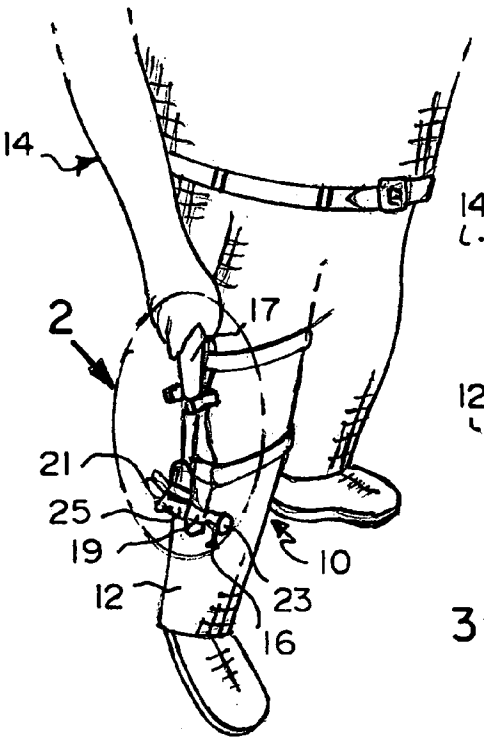
FIG. 1 is a diagrammatic perspective view of the present invention attached to the leg of a user and holding a hammer.

Referring now to the figures, in which like numerals indicate like parts, and particularly to FIG. 1, the holster of the present invention is shown generally at 10 for attaching to an leg 12 of a user 14 and holding a hammer 16. The hammer 16 has a handle 17 and a head 19. The head 19 of the hammer 16 extends transversely from the handle 17 of the hammer 16 so as to form a general T-shape, and has a claw 21, a bell/poll 23, and a cheek 25.

Figure 2:
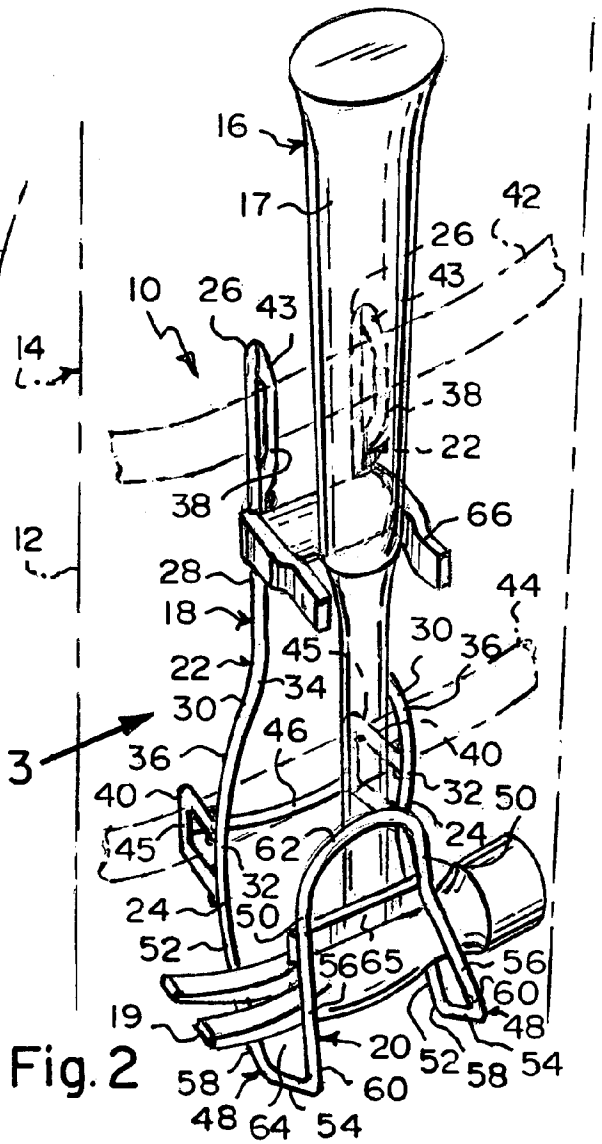
FIG. 2 is an enlarged diagrammatic perspective view of the area generally enclosed by the dotted curve identified by ARROW 2 in FIG. 1 of the present invention holding the hammer.

The specific configuration of the holster 10 can best be seen in FIGS. 2 and 3, and as such, will be discussed with reference thereto.

The holster 10 comprises an attaching portion 18 and a holding portion 20. The attaching portion 18 is for replaceably attaching to the leg 12 of the user 14, and the holding portion 20 extends from the attaching portion 18 and is for replaceably holding the hammer 16 in a position which provides complete freedom of movement of hands and feet of the user 14 and which permits the user 14 to remove the hammer 16 with the same hand employed to use the hammer 16.

The attaching portion 18 comprises a pair of extension members 22. The pair of extension members 22 of the attaching portion 18 are mirror images of each other, are vertically-oriented, are spaced-apart from each other, and lie in the same plane. Each extension member of the pair of extension members 22 of the attaching portion 18 is rod-like, i.e., slender and elongated.

Each extension member of the pair of extension members 22 of the attaching portion 18 has a lowermost end 24, an uppermost end 26, an upper portion 28, an intermediate portion 30, and a lower portion 32.

The upper portion 28 of each extension member of the pair of extension members 22 of the attaching portion 18 depends from the uppermost end 26 of an associated extension member of the pair of extension members 22 of the attaching portion 18 to a first transition point 34.

The upper portion 28 of each extension member of the pair of extension members 22 of the attaching portion 18 is straight and parallel to the other.

The intermediate portion 30 of each extension member of the pair of extension members 22 of the attaching portion 18 depends sidewardly outwardly from the first transition point 34 of the upper portion 28 of an associated extension member of the pair of extension members 22 of the attaching portion 18 to a second transition point 36.

The intermediate portion 30 of each extension member of the pair of extension members 22 of the attaching portion 18 is continuous with the upper portion 28 of an associated extension member of the pair of extension members 22 of the attaching portion 18 so as to allow the intermediate portion 30 of each extension member of the pair of extension members 22 of the attaching portion 18 to be one-piece with the upper portion 28 of the associated extension member of the pair of extension members 22 of the attaching portion 18.

The intermediate portion 30 of each extension member of the pair of extension members 22 of the attaching portion 18 is straight.

The lower portion 32 of each extension member of the pair of extension members 22 of the attaching portion 18 depends from the second transition point 36 of the intermediate portion 30 of an associated extension member of the pair of extension members 22 of the attaching portion 18 to the lowermost end 24 of the associated extension member of the pair of extension members 22 of the attaching portion 18.

The lower portion 32 of each extension member of the pair of extension members 22 of the attaching portion 18 is continuous with the intermediate portion 30 of an associated extension member of the pair of extension members 22 of the attaching portion 18 so as to allow the lower portion 32 of each extension member of the pair of extension members 22 of the attaching portion 18 to be one-piece with the intermediate portion 30 of the associated extension member of the pair of extension members 22 of the attaching portion 18.

The lower portion 32 of each extension member of the pair of extension members 22 of the attaching portion 18 is straight, parallel to the other, and outboard of, and parallel to, the upper portion 28 of an associated extension member of the pair of extension members 22 of the attaching portion 18.

Each extension member of the pair of extension members 22 of the attaching portion 18 further has an upper loop 38 and a lower loop 40.

The upper loop 38 of each extension member of the pair of extension members 22 of the attaching portion 18 is disposed at the uppermost end 26 of an associated extension member of the pair of extension members 22 of the attaching portion 18, extends forwardly therefrom, away from the leg 12 of the user 14 for comfort, and is for receiving an upper strap 42 for strapping around the leg 12 of the user 14.

The upper loop 38 of each extension member of the pair of extension members 22 of the attaching portion 18 is identical to the other, vertically-oriented, spaced-apart from the other, parallel to the other, and aligned with the other.

The upper loop 38 of each extension member of the pair of extension members 22 of the attaching portion 18 is formed by an upper member 43 welded to the uppermost end 26 of an associated extension member of the pair of extension members 22 of the attaching portion 18. It is to be noted that the instant invention may be readily fabricated from either metal or plastic and the use of the word welded is general and is not meant to imply necessarily that the invention would be best fabricated out of a particular material.

The upper member 43 of the upper loop 38 of each extension member of the pair of extension members 22 of the attaching portion 18 is arcuate-shaped, vertically-oriented, spaced-apart from the other, and parallel to the other.

The lower loop 40 of each extension member of the pair of extension members 22 of the attaching portion 18 is disposed at the lowermost end 24 of an associated extension member of the pair of extension members 22 of the attaching portion 18, extends rearwardly therefrom, towards the leg 12 of the user 14 for spacing to compensate for the depending taper of the leg 12 of the user 14, and is for receiving a lower strap 44 for strapping around the leg 12 of the user 14.

The lower loop 40 of each extension member of the pair of extension members 22 of the attaching portion 18 is identical to the other, vertically-oriented, spaced-apart from the other, parallel to the other, and aligned with the other.

The lower loop 40 of each extension member of the pair of extension members 22 of the attaching portion 18 is formed by a lower member 45 welded to the lowermost end 24 of an associated extension member of the pair of extension members 22 of the attaching portion 18.

The lower loop 40 of each extension member of the pair of extension members 22 of the attaching portion 18 is generally square-shaped, vertically-oriented, spaced-apart from the other, and parallel to the other.

The lower loop 40 of each extension member of the pair of extension members 22 of the attaching portion 18 is wider than the upper loop 38 of an associated extension member of the pair of extension members 22 of the attaching portion 18.

The attaching portion 18 further comprises a cross member 46. The cross member 46 of the attaching portion 18 extends from the lower loop 40 of one extension member of the pair of extension members 22 of the attaching portion 18 to the lower loop 40 of the other extension member of the pair of extension members 22 of the attaching portion 18. The cross member 46 of the attaching portion 18 is rod-like, i.e., slender and elongated, and arcs for conforming to the leg 12 of the user 14.

The holding portion 20 comprises a pair of segment members 48 for holding the head 19 of the hammer 16. The pair of segment members 48 of the holding portion 20 are mirror images of each other, are vertically-oriented, and are spaced-apart from each other. Each segment member of the pair of segment members 48 of the holding portion 20 is rod-like, i.e., slender and elongated.

Each segment member of the pair of segment members 48 of the holding portion 20 has a forwardmost end 50, a rear portion 52, a lower portion 54, and a forward portion 56.

The rear portion 52 of each segment member of the pair of segment members 48 of the holding portion 20 depends forwardly from the lowermost end 24 of an associated extension member of the pair of extension members 22 of the attaching portion 18 to a first transition point 58.

The rear portion 52 of each segment member of the pair of segment members 48 of the holding portion 20 is straight and parallel to the other.

The lower portion 54 of each segment member of the pair of segment members 48 of the holding portion 20 extends forwardly, upwardly, and inwardly from the first transition point 58 of the rear portion 52 of an associated segment member of the pair of segment members 48 of the holding portion 20 to a second transition point 60.

The lower portion 54 of each segment member of the pair of segment members 48 of the holding portion 20 is continuous with the rear portion 52 of an associated segment member of the pair of segment members 48 of the holding portion 20 so as to allow the lower portion 54 of each segment member of the pair of segment members 48 of the holding portion 20 to be one-piece with the rear portion 52 of the associated segment member of the pair of segment members 48 of the holding portion 20.

The lower portion 54 of each member of the pair of segment members 48 of the holding portion 20 is straight and converges towards the other.

The forward portion 56 of each segment member of the pair of segment members 48 of the holding portion 20 extends upwardly and inwardly from the second transition point 60 of the lower portion 54 of an associated segment member of the pair of segment members 48 of the holding portion 20 to the forwardmost end 50 of the associated segment member of the pair of segment members 48 of the holding portion 20.

The forward portion 56 of each segment member of the pair of segment members 48 of the holding portion 20 is continuous with the lower portion 54 of an associated segment member of the pair of segment members 48 of the holding portion 20 so as to allow the forward portion 56 of each segment member of the pair of segment members 48 of the holding portion 20 to be one-piece with the lower portion 54 of the associated segment member of the pair of segment members 48 of the holding portion 20.

The forward portion 56 of each segment member of the pair of segment members 48 of the holding portion 20 is straight, converges towards the other, and is inboard of, and lies in a general parallel plane to, the rear portion 52 of an associated segment member of the pair of segment members 48 of the holding portion 20.

The holding portion 20 further comprises a connecting member 62. The connecting member 62 of the holding portion 20 extends from the forwardmost end 50 of one segment member of the pair of segment members 48 of the holding portion 20 to the forwardmost end 50 of the other segment member of the pair of segment members 48 of the holding portion 20, and extends forwardly therefrom.

The connecting member 62 of the holding portion is continuous with the forward portion 54 of each segment member of the pair of segment members 48 of the holding portion 20 so as to allow the connecting member 62 of the holding portion to be one-piece with the forward portion 54 of an associated segment member of the pair of segment members 48 of the holding portion 20.

The connecting member 62 of the holding portion 20 is inverted U-shaped.

The pair of segment members 48 of the holding portion 20 and the connecting member 62 of the holding portion 20 form a cradle 64. The cradle 64 of the holding portion 20 is for replaceably cradling the head 19 of the hammer 16 therein, with the handle 17 of the hammer 16 extending upwardly therefrom, with the claw 21 of the hammer 16 extending replaceably through one segment member of the pair of segment members 48 of the holding portion 20, and with the bell/poll 23 of the hammer 16 extending replaceably through the other segment member of the pair of segment members 48 of the holding portion 20.

The holding portion 20 further comprises a cross member 65. The cross member 65 of the holding portion 20 extends horizontally from, and is welded to, the forwardmost end 50 of one segment member of the pair of segment members 48 of the holding portion 20 to, and is welded to, the forwardmost end 50 of the other segment member of the pair of segment members 48 of the holding portion 20.

The cross member 65 of the holding portion 20 is flat and elongated, and is for abutting against the cheek 25 of the head 19 of the hammer 16 and urging the head 19 of the hammer 16 against the rear portion 52 of each segment member of the pair of segment members 48 of the holding portion 20 so as to replaceably maintain the head 19 of the hammer 16 in the cradle 64 of the holding portion 20.

The holding member 20 further comprises catch 66. The catch 66 of the holding member 20 is generally U-shaped, extends forwardly from the upper portion 28 of each extension member of the pair of extension members 22 of the attaching portion 18, just below the upper loop 38 of each extension member of the pair of extension members 22 of the attaching portion 18, and is for replaceably capturing the handle 17 of the hammer 16 therein.

The catch 66 of the holding member 20 is welded on the upper portion 28 of each extension member of the pair of extension members 22 of the attaching portion 18.

It will be understood that each of the elements described above, or two or more together, may also find a useful application in other types of constructions differing from the types described above.

While the invention has been illustrated and described as embodied in a holster for attaching to a leg of a user and holding a hammer, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A holster for attaching to an leg of a user and holding a hammer, wherein the hammer has a handle and a head, and wherein the head of the hammer extends transversely from the handle of the hammer so as to form a general T-shape, said holster comprising:

a) an attaching portion; and b) a holding portion;

wherein said attaching portion is for replaceably attaching to the leg of the user;

wherein said holding portion extends from said attaching portion; wherein said holding portion is for replaceable holding the hammer in a position which provides complete freedom of movement of hands and feet of the user and which permits the user to remove the hammer with the same hand employed to use the hammer, wherein said attaching portion comprises a pair of extension members;

wherein each extension member of said pair of extension members said attaching portion has a lowermost end;

wherein each extension member of said pair of extension members of said attaching portion has an uppermost end;

wherein each tension member of said pair of extension members of said attaching portion has an upper portion;

wherein each extension member of said pair of extension members of said attaching portion has an intermediate portion;

wherein each extension member of said air of extension members of said attaching portion has a lower portion;

wherein each extension member of said pair of extension members of said attaching portion has an upper loop;

wherein each extension member of said air of extension members of said attaching portion has a lower loop;

wherein said upper loop of each extension member of said pair of extension members of said attaching portion is disposed at said uppermost end of an associated extension member of said pair of extension members of said attaching portion;

wherein said upper loop of each extension member of said pair of extension members of said attaching portion extends forwardly from said uppermost end of said associated extension member of said pair of extension members of said attaching portion, away from the leg of the user for comfort;

wherein said upper loop of each extension member of said pair of extension members of said attaching portion is for receiving an upper strap; and wherein the upper strap is for strapping around the leg of the user.

2. The holster as defined in claim 1, wherein said pair of extension members of said attaching portion are mirror images of each other;

wherein said pair of extension members of said attaching portion are vertically-oriented;

wherein said pair of extension members of said attaching portion are spaced-apart from each other;

wherein said pair of extension members of said attaching portion lie in the same plane;

wherein each extension member of said pair of extension members of said attaching portion is rod-like;

wherein each extension member of said pair of extension members of said attaching portion is slender; and wherein each extension member of said pair of extension members of said attaching portion is elongated.

3. The holster as defined in claim 1, wherein said upper portion of each extension member of said pair of extension members of said attaching portion depends from said uppermost end of an associated extension member of said pair of extension members of said attaching portion to a first transition point.

4. The holster as defined in claim 1, wherein said upper portion of each extension member of said pair of extension members of said attaching portion is straight; and wherein said upper portion of each extension member of said pair of extension members of said attaching portion is parallel to the other.

5. The holster as defined in claim 3, wherein said intermediate portion of each extension member of said pair of extension members of said attaching portion depends sidewardly outwardly from said first transition point of said upper portion of an associated extension member of said pair of extension members of said attaching portion to a second transition point.

6. The holster as defined in claim 1, wherein said intermediate portion of each extension member of said pair of extension members of said attaching portion is continuous with said upper portion of an associated extension member of said pair of extension members of said attaching portion so as to allow said intermediate portion of each extension member of said pair of extension members of said attaching portion to be one-piece with said upper portion of said associated extension member of said pair of extension members of said attaching portion.

7. The holster as defined in claim 1, wherein said intermediate portion of each extension member of said pair of extension members of said attaching portion is straight.

8. The holster as defined in claim 5, wherein said lower portion of each extension member of said pair of extension members of said attaching portion depends from said second transition point of said intermediate portion of an associated extension member of said pair of extension members of said attaching portion to said lowermost end of said associated extension member of said pair of extension members of said attaching portion.

9. The holster as defined in claim 5, wherein said lower portion of each extension member of said pair of extension members of said attaching portion is continuous with said intermediate portion of an associated extension member of said pair of extension members of said attaching portion so as to allow said lower portion of each extension member of said pair of extension members of said attaching portion to be one-piece with said intermediate portion of said associated extension member of said pair of extension members of said attaching portion.

10. The holster as defined in claim 1, wherein said lower portion of each said member of said pair of said members of said attaching portion is straight;

wherein said lower portion of each extension member of said pair of extension members of said attaching portion is parallel to the other;

wherein said lower portion of each extension member of said pair of extension members of said attaching portion is outboard of said upper portion of an associated extension member of said pair of extension members of said attaching portion; and wherein said lower portion of each extension member of said pair of extension members of said attaching portion is parallel to said upper portion of said associated extension member of said pair of extension members of said attaching portion.

11. The holster as defined in claim 1, wherein said upper loop of each extension member of said pair of extension members of said attaching portion is identical to the other;

wherein said upper loop of each extension member of said pair of extension members of said attaching portion is vertically-oriented;

wherein said upper loop of each extension member of said pair of extension members of said attaching portion is spaced-apart from the other;

wherein said upper loop of each extension member of said pair of extension members of said attaching portion is parallel to the other; and wherein said upper loop of each extension member of said pair of extension members of said attaching portion is aligned with the other.

12. The holster as defined in claim 1, wherein said upper loop of each extension member of said pair of extension members of said attaching portion is formed by an upper member; and wherein said upper member of said upper loop of each extension member of said pair of extension members of said attaching portion is attached to said uppermost end of an associated extension member of said pair of extension members of said attaching portion.

13. The holster as defined in claim 1, wherein said upper extension member of said upper loop of each extension member of said pair of extension members of said attaching portion is welded to said uppermost end of an associated extension member of said pair of extension members of said attaching portion.

14. The holster as defined in claim 12, wherein said upper member of said upper loop of each extension member of said pair of extension members of said attaching portion is arcuate-shaped;

wherein said upper member of said upper loop of each extension member of said pair of extension members of said attaching portion is vertically-oriented;

wherein said upper member of said upper loop of each extension member of said pair of extension members of said attaching portion is spaced-apart from the other; and wherein said upper member of said upper loop of each extension member of said pair of extension members of said attaching portion is parallel to the other.

15. The holster as defined in claim 1, wherein said lower loop of each extension member of said pair of extension members of said attaching portion is disposed at said lowermost end of an associated extension member of said pair of extension members of said attaching portion;

wherein said lower loop of each extension member of said pair of extension members of said attaching portion extends rearwardly from said lowermost end of said associated extension member of said pair of extension members of said attaching portion, towards the leg of the user for spacing to compensate for the depending taper of the leg of the user;

wherein said lower loop of each extension member of said pair of members of said attaching portion is for receiving a lower strap; and wherein the lower strap is for strapping around the leg of the user.

16. The holster as defined in claim 1, wherein said lower loop of each extension member of said pair of extension members of said attaching portion is identical to the other;

wherein said lower loop of each extension member of said pair of extension members of said attaching portion is vertically-oriented;

wherein said lower loop of each extension member of said pair of extension members of said attaching portion is spaced-apart from the other;

wherein said lower loop of each extension member of said pair of extension members of said attaching portion is parallel to the other; and wherein said lower loop of each extension member of said pair of extension members of said attaching portion is aligned with the other.

17. The holster as defined in claim 1, wherein said lower loop of each extension member of said pair of extension members of said attaching portion is formed by a lower member; and wherein said lower member is attached to said lowermost end of an associated extension member of said pair of extension members of said attaching portion.

18. The holster as defined in claim 17, wherein said lower member of said lower loop of each extension member of said pair of extension members of said attaching portion is welded to said lowermost end of an associated extension member of said pair of extension members of said attaching portion.

19. The holster as defined in claim 17, wherein said lower loop of each extension member of said pair of extension members of said attaching portion is generally square-shaped;

wherein said lower member of said lower loop of each extension member of said pair of extension members of said attaching portion is straight;

wherein said lower member of said lower loop of each extension member of said pair of extension members of said attaching portion is vertically-oriented;

wherein said lower member of said lower loop of each extension member of said pair of extension members of said attaching portion is spaced-apart from the other; and wherein said lower member of said lower loop of each extension member of said pair of extension members of said attaching portion is parallel to the other.

20. The holster as defined in claim 1, wherein said lower loop of each extension member of said pair of extension members of said attaching portion is wider than said loop of an associated extension member of said pair of extension members of said attaching portion.

21. The holster as defined in claim 1, wherein said attaching portion comprises a cross member; and wherein said cross member of said attaching portion extends from said lower loop of one extension member of said pair of extension members of said attaching portion to said lower loop of the other extension member of said pair of extension members of said attaching portion.

22. The holster as defined in claim 21, wherein said cross member of said attaching portion is rod-like;

wherein said cross member of said attaching portion is slender)

wherein said cross member of said attaching portion is elongated; and wherein said cross member of said attaching portion arcs for conforming to the leg of the user.

23. The holster as defined in claim 1, wherein said holding portion comprises a pair of segment members; and wherein said pair of segment members of said holding portion are for holding the head of the hammer.

24. The holster as defined in claim 23, wherein said pair of segment members of said holding portion are mirror images of each other;

wherein said pair of segment members of said holding portion are vertically-oriented;

wherein said pair of segment members of said holding portion are spaced-apart from each other;

wherein each segment member of said pair of segment members of said holding portion is rod-like;

wherein each segment member of said pair of segment members of said holding portion is slender; and wherein each segment member of said pair of segment members of said holding portion is elongated.

25. The holster as defined in claim 23, wherein each segment member of said pair of segment members of said holding portion has a forwardmost end;

wherein each segment member of said pair of segment members of said holding portion has a rear portion;

wherein each segment member of said pair of segment members of said holding portion has a lower portion; and wherein each segment member of said pair of segment members of said holding portion has a forward portion.

26. The holster as defined in claim 25, wherein said rear portion of each segment member of said pair of segment members of said holding portion depends forwardly from said lowermost end of an associated extension member of said pair of extension members of said attaching portion to a first transition point.

27. The holster as defined in claim 25, wherein said rear portion of each segment member of said pair of segment members of said holding portion is straight; and wherein said rear portion of each segment member of said pair of segment members of said holding portion is parallel to the other.

28. The holster as defined in claim 26, wherein said lower portion of each segment member of said pair of segment members of said holding portion extends forwardly, upwardly, and inwardly from said first transition point of said rear portion of an associated segment member of said pair of segment members of said holding portion to a second transition point.

29. The holster as defined in claim 25, wherein said lower portion of each segment member of said pair of segment members of said holding portion is continuous with said rear portion of an associated segment member of said pair of segment members of said holding portion so as to allow said lower portion of each segment member of said pair of segment members of said holding portion to be one-piece with said rear portion of said associated segment member of said pair of segment members of said holding portion.

30. The holster as defined in claim 25, wherein said lower portion of each segment member of said pair of segment members of said holding portion is straight; and wherein said lower portion of each segment member of said pair of segment members of said holding portion converges towards the other.

31. The holster as defined in claim 28, wherein said forward portion of each segment member of said pair of segment members of said holding portion extends upwardly and inwardly from said second transition point of said lower portion of an associated segment member of said pair of segment members of said holding portion to said forwardmost end of said associated segment member of said pair of segment members of said holding portion.

32. The holster as defined in claim 25, wherein said forward portion of each segment member of said pair of segment members of said holding portion is continuous with said lower portion of an associated segment member of said pair of segment members of said holding portion so as to allow said forward portion of each segment member of said pair of segment members of said holding portion to be one-piece with said lower portion of said associated segment member of said pair of segment members of said holding portion.

33. The holster as defined in claim 25, wherein said forward portion of each segment member of said pair of segment members of said holding portion is straight;

wherein said forward portion of each segment member of said pair of segment members of said holding portion converges towards the other;

wherein said forward portion of each segment member of said pair of segment members of said holding portion is inboard of said rear portion of an associated segment member of said pair of segment members of said holding portion; and wherein said forward portion of each segment member of said pair of segment members of said holding portion lies in a general parallel plane to said rear portion of an associated segment member of said pair of segment members of said holding portion.

34. The holster as defined in claim 29, wherein said holding portion comprises a connecting member;

wherein said connecting member of said holding portion extends from said forwardmost end of one segment member of said pair of segment members of said holding portion to said forwardmost end of the other segment member of said pair of segment members of said holding portion; and wherein said connecting member of said holding portion extends forwardly from said forwardmost end of each segment member of said pair of segment members of said holding portion.

35. The holster as defined in claim 34, wherein said connecting member of said holding portion is continuous with said forward portion of each segment member of said pair of segment members of said holding portion so as to allow said connecting member of said holding portion to be one-piece with said forward portion of an associated segment member of said pair of segment members of said holding portion.

36. The holster as defined in claim 34, wherein said connecting member of said holding portion is inverted U-shaped.

37. The holster as defined in claim 34, wherein the head of the hammer has a claw;

wherein the head of the hammer has a bell/poll;

wherein said pair of segment members of said holding portion and said connecting member of said holding portion form a cradle; and wherein said cradle of said holding portion is for replaceably cradling the head of the hammer therein, with the handle of the hammer extending upwardly therefrom, with the claw of the hammer extending replaceably through one segment member of said pair of segment members of said holding portion, and with the bell/poll of the hammer extending replaceably through the other segment member of said pair of segment members of said holding portion.

38. The holster as defined in claim 37, wherein said holding portion comprises a cross member; and wherein said cross member of said holding portion extends horizontally from said forwardmost end of one segment member of said pair of members of said holding portion to said forwardmost end of the other segment member of said pair of segment members of said holding portion.

39. The holster as defined in claim 38, wherein the head of the hammer has a cheek;

wherein said cross member of said holding portion is flat;

wherein said cross member of said holding portion is elongated; and wherein said cross member of said holding portion is for abutting against the cheek of the head of the hammer and urging the head of the hammer against said rear portion of each segment member of said pair of segment members of said holding portion so as to replaceably maintain the head of the hammer in said cradle of said holding portion.

40. The holster as defined in claim 1, wherein said holding member comprises a catch;

wherein said catch of said holding member is generally U-shaped;

wherein said catch of said holding member extends forwardly from said upper portion of each extension member of said pair of extension members of said a attaching portion;

wherein said catch of said holding member extends just below said upper loop of each extension member of said pair of extension members of said attaching portion; and wherein said catch of said holding member is for replaceably capturing the handle of the hammer therein.

* * * * *